United States Patent [19]

Silvestrini

[11] Patent Number: 4,929,459

[45] Date of Patent: May 29, 1990

[54] METHOD OF FILLING DRUMS WITH COOKED SOLID FOOD PRODUCTS

[75] Inventor: Jesus A. Silvestrini, Mendoza, Argentina

[73] Assignee: IMDEC S.A., Mendoza, Argentina

[21] Appl. No.: 258,730

[22] Filed: Oct. 17, 1988

Related U.S. Application Data

[63] Continuation-in-part of Ser. No. 216,874, Jul. 8, 1988.

[51] Int. Cl.[5] ..... A23L 3/00

[52] U.S. Cl. ..... 426/399; 426/392; 426/397; 53/440

[58] Field of Search ..... 426/392, 399, 400, 407, 426/397, 131, ; 53/440, 432

[56] References Cited

U.S. PATENT DOCUMENTS

| | | | |
|---|---|---|---|
| 704,258 | 7/1902 | Hodgson | 426/407 |
| 1,162,520 | 11/1915 | Shaffer | 426/407 X |
| 2,541,113 | 2/1951 | Smith, Jr. et al. | 99/184 |
| 2,984,057 | 5/1961 | Bellato | 53/37 |
| 3,103,089 | 9/1963 | Allen | 53/471 |
| 3,356,510 | 12/1967 | Barnby | 99/182 |
| 3,385,022 | 5/1968 | Anderson | 53/11 |
| 3,437,495 | 4/1969 | Jeppson | 426/400 |
| 4,125,632 | 11/1978 | Vosti et al. | 426/111 |
| 4,254,152 | 3/1981 | Janovtchik | 426/399 |
| 4,419,376 | 12/1983 | Hersom et al. | 426/402 |
| 4,497,855 | 2/1985 | Agrawal et al. | 426/399 |
| 4,522,015 | 6/1985 | Hildebolt | 53/425 |
| 4,542,029 | 9/1985 | Canner et al. | 426/399 |
| 4,560,564 | 12/1985 | Bruno, Jr. et al. | 426/399 |

*Primary Examiner*—Donald E. Czaja
*Assistant Examiner*—D. Workman
*Attorney, Agent, or Firm*—Pettis & McDonald

[57] ABSTRACT

A method of filling drums with cooked sterile pieces of solid food products in a packing liquid includes depositing a predetermined quantity of the pieces of solid food product by gravity flow into a sterilized drum substantially without packing liquid, then engaging the drum in a pressure-tight manner with the liquid filling head introducing pressurized steam through that filling head and maintaining steam pressure within the drum and the liquid filling head while introducing a packing liquid into the drum, then applying an air tight seal to the drum head and subsequently releasing the steam pressure from the liquid filling head and removing the liquid filling head.

7 Claims, 1 Drawing Sheet

METHOD OF FILLING DRUMS WITH COOKED SOLID FOOD PRODUCTS

RELATED APPLICATION

This application is a continuation-in-part of patent application Ser. No. 07/216,874 entitled Method of Filling Drums With Cooked Solid Food Products, filed July 8, 1988, in the name of Jesus A. Silvestrini.

BACKGROUND OF THE INVENTION

This invention relates generally to the field of food processing and more particularly to the field of filling containers with processed food products. Even more specifically, it pertains to a method of filling storage drums with cooked, sterile pieces of solid food product in a packing liquid.

Numerous techniques have long been known for canning or aseptically packaging food products in containers. In many of these prior art methods the food product along with its juice or a syrup or other appropriate packing liquid are placed in a container and cooked or sterilized while in that container. The container is then sealed and cooled. Prior art techniques have also been known for bulk packaging of food products, some of them in steel drums.

Recently, interest has increased in packing food products in bulk quantities in drums of 200 liters capacity or more. It has been found that partially processed products, such as tomato dices or fruit cocktail or similar items comprising cooked sterile pieces of solid food product, may be stored in these large containers at the time of initial processing of the product and then later processed and repackaged into individual cans and packages for distribution and retail sale. In these processes aseptic packaging is critical to maintain the quality and purity of the product until it is finally processed for packaging and distribution.

Because of both the packaging and the storage volume requirements, it is desirable to pack as much as the solid food product as possible into the drum, along with the packing liquid, and to eliminate air from the drum to the greatest extent possible.

SUMMARY OF THE INVENTION

In view of the desirable goals of packaging partially processed solid food items in large containers, such as metal drums, it is an object of the present invention to provide a method for such packaging that increases the quantity of such solid food items that may be packed within a given drum. It is another object of the invention to provide such a method that facilitates aseptic packing of such bulk food products and protects against contamination. To achieve these and other objects that will become apparent to those skilled in the art, there is a method provided for filling drums with cooked, sterile pieces of solid food products in a packing liquid. This method includes the steps of sterilizing the interior of an empty drum, depositing by gravity flow into the sterilized drum through an opening in the drum head a predetermined quantity of cooked, sterile pieces of solid food product substantially without packing liquid, engaging the drum head in a pressure-tight manner with a liquid filling head, introducing pressurized steam through the liquid filling head and expelling substantially all air from within the drum and maintaining within the drum and between the drum head and the liquid filling head steam pressure substantially greater than atmospheric pressure. Additionally, the process includes adding a quantity of food packing liquid sufficient to substantially fill the space remaining in the drum, applying an air tight seal to the drum head to seal the drum against outside contaminants and then releasing the steam pressure and removing the liquid filling head.

BRIEF DESCRIPTION OF THE DRAWINGS

Particular preferred embodiments of the method of this invention are described below in detail in connection with the drawings in which.

DETAILED DESCRIPTION OF A PREFERRED EMBODIMENT

Figures 1, 2:
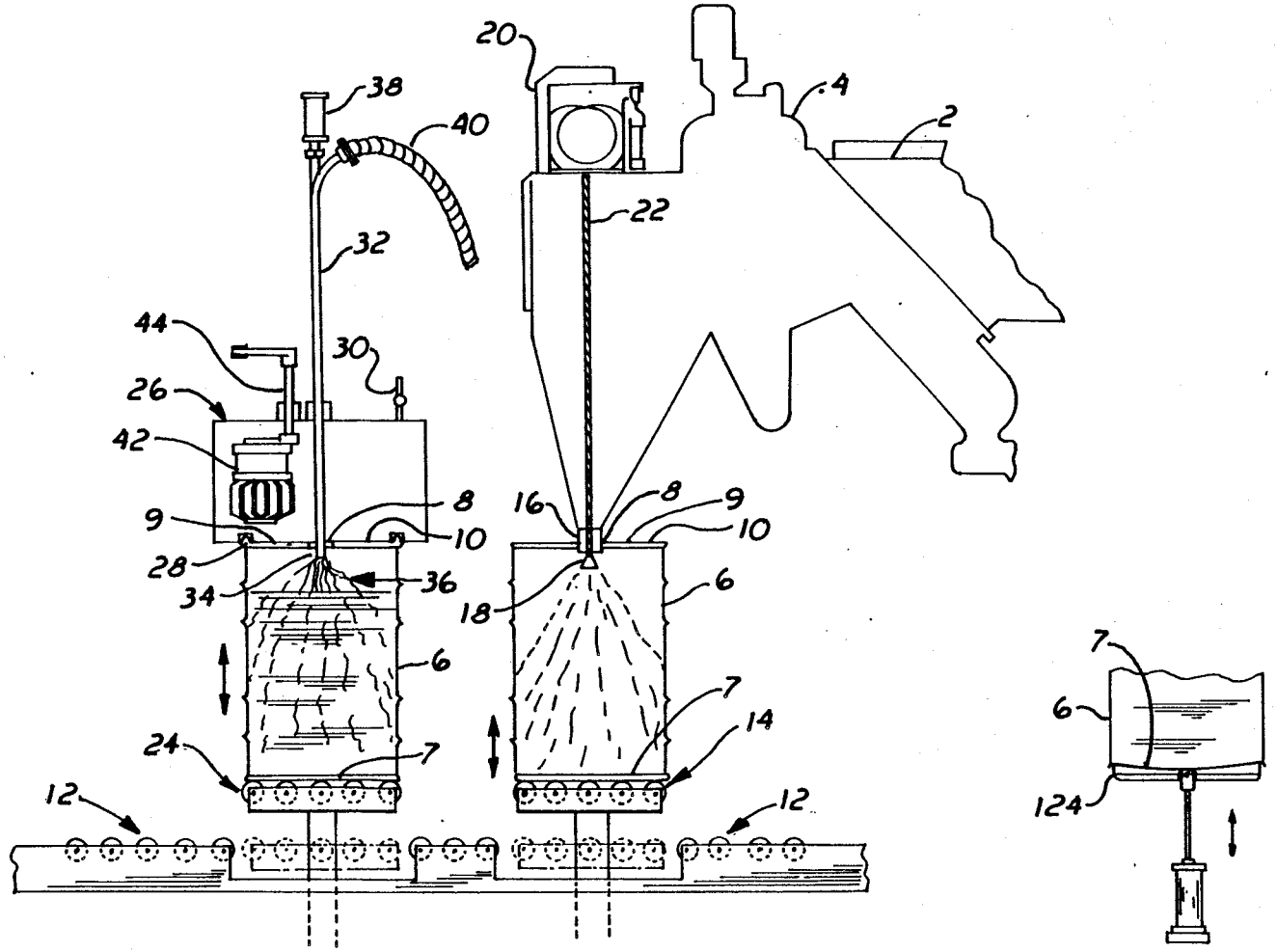
FIG. 1 illustrates the steps involved in the process of this invention as practiced in one preferred manner by suitable apparatus.
FIG. 2 illustrates an alternative preferred apparatus for supporting the base of drum during the liquid filling process of this invention.

A preferred embodiment of apparatus and process steps for practicing the method of this invention is illustrated in the schematic representation of FIG. 1. This apparatus is used for cooking and sterilizing solid food products, including chunks or slices of fruits, such as peaches, pears, apricots, cherries and others and vegetables, including tomatoes among numerous other items. The pieces of the solid food product are cooked in a known manner in conventional cooking apparatus 2, heating those pieces of the food product to a sterilizing temperature in excess of 200° F. These pieces are then conveyed by the cooker to an elevator and delivery unit 4, also of known construction, that is used for depositing the pieces of the food product into a packing drum.

An empty packing drum 6, which may conveniently be of a 55 gallon (209 liter) size in the United States or typically of a 220 liter size in many other countries, is sterilized in a conventional manner, such as by introduction of high temperature steam through an opening 8 in the head member 9 covering and closing the head 10 of that drum. The opening 8 typically is on the order of a four to five inch diameter. This drum 6 comprises a substantially rigid cylinder having a base at one axial end thereof closed by a base member 7 extending thereacross and having at the opposing axial end the head 10 closed by the head member. The drum 6 preferably is fabricated of steel or other suitable metal and is coated on the inside with a protective coating to prevent corrosion of the metal by the food product and packing liquid. An empty sterilized drum 6 of this nature is moved into place, suitably by conveying rollers 12, onto a platform 14. This platform 14 may be raised above the level of the roller conveyor 12 by suitable means, such as by a hydraulic cylinder, and preferably includes a scale built into it to indicate the weight of material introduced into the drum. This platform 14 with its lift and scale, with the food product filling elevator above, conveniently is defined as a first drum filling station.

As shown in FIG. 1, elevation of the drum on platform 14 serves to bring a discharge tube 16 adjacent the lower extremity of the food product elevator 4 into engagement with the filling port 8 located in the drum head 10. Until such engagement the conical plug 18 is retracted within the outlet 16, effectively closing and sealing that outlet. Once the drum has been brought into engagement with the outlet 16, a conventional actuator 20 urges the shaft 22 and the conical plug 18 downwardly, opening the channel through the outlet 16 for communication between the food product elevator 4 and the interior of the drum 6. Then, by operation of the food product elevator 4, cooked, sterile pieces of the desired food product are deposited by gravity flow into the interior of the sterilized drum 6. These pieces of solid food product are deposited within the drum substantially without any packing liquid, such as juice, syrup or water, although some minor amounts may inherently accompany the pieces of the food product. Such filling with the pieces of the solid food product continues until a predetermined quantity has been deposited in the drum. Typically, the amount deposited would fill about 80% of the volume of the drum 6. This predetermined amount is measured by the increasing weight of the drum as measured by the scale incorporated into platform 14. Once the desired amount has been deposited, the actuator 20 operates again to raise the shaft 22 and thus bring the plug 18 back into engagement with the outlet 16 of the elevator 4, thus closing off further flow into the drum.

In this preferred embodiment the drum 6 is then lowered, with its contents of solid food product, back to the level of the roller conveyor 12. The drum is then moved over to a second platform 24, that may conveniently be substantially similar to platform 14 and likewise capable of being raised above the level of the roller conveyor 12. This platform 24 preferably is configured to provide support to the peripheral portion of the base of the drum 6 while providing for a certain axial deflection of the base member 7 outwardly of the drum, for purposes to be described below. Such support may be provided by rollers that have a smaller diameter on the portion adjacent the radially central portion of the drum base than the portion engaging the radially outer portion of that drum base. Alternatively, as illustrated in FIG. 2, in a platform 124 for supporting the drum base without rollers, that platform 124 may be formed in a concave manner with the central portion slightly below the level of the peripheral portion. While the drawing of FIG. 2 is exaggerated for purposes of illustration, the center of the platform 124 may conveniently be about one-half inch lower than the periphery thereof. The platform 24 or 124 is one convenient manner of providing for relative movement, in a generally vertical direction, between the drum 6 and a liquid filling head 26. The platform 24 and the liquid filling head 26 may thus comprise one embodiment of a second filling station.

At this second filling station the drum head 10 is brought into engagement with the liquid filling head 26 in a pressure-tight manner. Suitably, this engagement may comprise a resilient sealing member, such as a large o-ring 28, or some functional equivalent, that engages the rim of the drum head 10. With the drum 6 and drum head 10 in pressure-tight engagement with the liquid filling head 26, pressurized steam is introduced, suitably through conduit 30, through the liquid filling head 26 into the space between the filling head 26 and the drum head 10, and into the interior of the drum 6 itself. This steam may suitably be at a temperature of 200° F. or greater to effect sterilization of all parts of the second filling station and the drum that is contacted by the steam. At this time the space enclosed by the liquid filling head 26 may then be vented in a conventional manner to the atmosphere to allow the steam to expel from within the drum and within the filling head 26 any air that may have remained. Subsequent to the venting, additional steam is brought in through the conduit 30 to maintain within the drum and between the drum and the liquid filling head a steam pressure substantially greater than ambient atmospheric pressure. Suitably this pressure may be in the range between about 5 p.s.i above ambient and about 15 p.s.i., thus urging some compaction of the cooked, sterile pieces of the solid food product within the drum.

With this steam pressure being maintained within the drum 6 and within the liquid filling head 26, a packing liquid may be introduced into the drum. Conveniently, a liquid filling tube 32, extending through the liquid filling head 26, has a lower portion 34 that is extended into the orifice 8 through the head member 9 of the drum 6. At the outermost extremity of this portion 34 of the tube 32 there is provided a movable plug 36 that effectively blocks or seals the lowermost end of that tube 32. The plug 36 may be urged out of its blocking engagement by a conventional actuator 38 connected to the filling tube 32. When that tube 32, and specifically its lowermost portion 34, is opened by the actuator 38, a suitable packing liquid may be introduced through a conduit 40 joined to the tube 32. This packing liquid may conveniently be water, brine, syrup from cooking or numerous other packing liquids, depending upon the type of fruit or vegetable and the final intended use of the processed solid product that is loaded into the drum 6. This packing liquid is introduced into the drum while the steam pressure is maintained within the liquid filling head 26 by the steam conduit 30.

The packing liquid may be introduced in either of two forms. In the first form, the packing liquid is introduced at a temperature of not less than about 200° F., with that temperature maintaining the juice sterile while it is being introduced. Alternatively, a packing liquid that has been sterilized and cooled in an aseptic manner may be added, at a temperature between 30° F. and 45° F., and preferably at approximately 35° F., to the solid food product in the drum. The amount of packing liquid introduced can be determined either by measuring the level of the liquid in the drum, by measuring the weight of the drum, or by measuring the volume of the liquid flowing into the drum, to achieve the desired level of filling. Either form of the packing liquid will work satisfactorily. The use of cold sterile liquid has an advantage in decreasing the total cooling time that will subsequently be required to bring the contents of the drum down to a storage temperature. Where the hot liquid is used, the average temperature of the drum is about 200° F. When cold sterile packing liquid is added at a temperature of 35° F., the average temperature of the total product in the drum is about 166° F. By the use of the pressurized steam within the drum, the steam pressure preferably is sufficient to deflect the drum base member 7 axially outwardly of the drum a distance greater than would result from only the weight of the solid food product and the food packing liquid. This additional deflection of the drum base member 7 is maintained through the application of an air tight seal into the opening 8 in the drum head member 9.

Once the filling of both the solid food product and the packing liquid has been completed, the filling tube 32 is withdrawn by lifting it up, away from the opening 8 in the drum head member 9, all the while maintaining the steam pressure within the liquid filling head 26. Then, a conventional seaming head 42 is swung into place about shaft 44 and lowered into engagement with the drum head opening 8, placing a plug into that opening 8. In the conventional and known manner the seaming head 42 sealingly expands or crimps that plug in place to effect an air tight seal to the drum head and thus prevent entry of any outside contaminants. Once the drum head is completely sealed, the steam pressure within the liquid filling head 26 is released and that liquid filling head 26 is removed from engagement with the drum 6, suitably by lowering platform 24 down to the level of roller conveyor 12. At that point the filled drum may then be rolled away to a cooling station where the drum and its contents may be subjected to cooling showers, suitably in the manner disclosed in my U.S. Pat. No. 4,505,670.

By the use of the method described above, several benefits may be obtained. By the use of a gravity flow loading of the pieces of solid food product, without pressurization of the drum in that step, the apparatus is kept relatively simple and particularly easy to clean and maintain. Then, by applying steam pressure to the drum after it has been filled with the solid food pieces and during the introduction of the liquid, the contained quantity of solid food pieces may be noticeably compressed, so that a larger quantity by weight may occupy the same volume. Thus, after the desired amount of packing liquid has been added, a drum packed by the method of this invention may contain up to 10 pounds more of the solid food product, even with the desired quantity of liquid, than drums packed by conventional and known techniques. The process of this invention provides both greater uniformity of drum packing and also as much as three percent more product in each drum than with known techniques. Thus, a greater quantity of the desired food product may be stored in the same number of drums for subsequent additional processing and repackaging.

Additional significant benefits also arise from the pressure filling technique of this invention. By the use of the pressurized filling, instead of atmospheric filling, the vacuum created within the drum upon cooling is materially reduced, thus reducing both the tendency to draw contaminants into the drum and the tendency to inwardly collapse the drum. This enables drums of significantly thinner, lighter and less expensive material to be used in place of the drums presently employed. It has been found that by using conventional techniques, the vacuum created within the drums after cooling was on the order of 22 to 24 in.Hg. This has required that the drums be fabricated of 18 gauge steel for the cylindrical side wall and 16 gauge steel for the base and head members, resulting in a 55 gallon drum weighing some 52 pounds empty. By filling the drums with a combination of 80% by volume of tomato dices and 20% tomato juice at about 200° F., under a steam pressure within the head of 5 p.s.i., the ultimate vacuum drawn in the fully cooled, sealed drum was reduced to 19.5 in.Hg. By the use of 7 p.s.i. steam pressure during filling, the final vacuum was reduced to 17.5 in.Hg., and the use of 9 p.s.i. steam pressure resulted in the final vacuum dropping to 16 in.Hg., even when the base of the drum was not permitted to deflect outwardly. When a modified platform having a concave center was used, such as platform 124 of FIG. 2, permitting the drum base member to deflect axially outwardly of the drum during filling and sealing, even greater reductions in the final vacuum were noted. With such deflection, the use of 5 p.s.i. steam pressure during filling resulted in a final vacuum in the cooled drum of 17 in.Hg.; the use of 7 p.s.i. steam pressure resulted in a final vacuum of 13.5 in.Hg.; and the use 9 p.s.i. steam filling pressure resulted in a final vacuum as low as 11 in.Hg., compared to the 22 to 24 in.Hg. vacuum drawn by conventional apparatus. This dramatic reduction in vacuum within the drum has reduced the tendency to draw contaminants into the drum past the seal of the plug in opening 8 of the drum head member 9 and has enabled the use of lighter weight drums fabricated of 19 gauge steel for the cylindrical side walls and 18 gauge steel for the base and head members. This permits the use of a drum weighing only 41 pounds, compared to the 52 pound drum of the same volume required for conventional processes. The method of this invention thus results in both a reduction in contamination of the food product contained within and a reduction of some 11 pounds in the shipping weight, with resulting reduction in shipping expenses, as compared to conventional drum filling methods.

It is to be understood that the preferred embodiment of the method of this invention described above is to be considered illustrative only of the principles of this invention. Numerous other modifications and variations of this method will readily occur to those skilled in the art. Some of these variations may include bringing the outlet of the solid food product elevator down to the drum rather than raising the drum to the food product elevator and likewise lowering the liquid filling head into engagement with the drum, rather than raising the drum into engagement with it. Furthermore, the filling tubes of the two filling stations may be swung into sequential engagement with a stationary drum, rather than moving the drum from one station to the next. This is considered to be an obvious variation that is fully encompassed within the scope of this invention. Accordingly, the invention is to be defined not by the detailed description of the preferred embodiment set forth above but solely by the claims appended hereto.

What is claimed is:

1. A method of filling drums with cooked, sterile pieces of solid food products in a packing liquid, comprising the sequential steps of a. sterilizing the interior of an empty drum, which drum comprises a substantially rigid cylinder having at one axial end thereof a base closed by a base member and at the opposite axial end a head closed by a head member;

b. depositing by gravity flow and at substantially atmospheric pressure into said sterilized drum through an opening in said head member a predetermined quantity of cooked, sterile pieces of solid food product having a temperature of not less than 200° F. and substantially without packing liquid;

c. engaging said drum head in a pressure-tight manner with a liquid filling head and maintaining said pressure-tight engagement between said drum head and said liquid filling head throughout said filling process while exposing the exterior of said drum base and the drum sides to ambient conditions;

d. introducing pressurized steam through said liquid filling head into said drum and thereby expelling substantially all air from within said drum and maintaining within said drum and between said drum head and said liquid filling head steam pressure substantially greater than atmospheric pressure;

e. introducing through said liquid filling head and into said drum and onto said quantity of pieces of solid food product a quantity of food packing liquid sufficient to substantially fill the space remaining in said drum;

f. applying an air tight seal to said drum head member opening, whereby the drum is sealed against outside contaminants, and g. releasing said steam pressure from said liquid filling head and removing said liquid filling head, whereby the filled and sealed drum may be removed for cooling and storing.

2. The method of claim 1 wherein said pieces of solid food product, are deposited into said drum at a first filling station, and said drum is then moved to a second filling station for engagement with said liquid filling head.

3. The method of claim 1 wherein said food packing liquid is introduced into said drum at a temperature of at least 200° F.

4. The method of claim 1 wherein said food packing liquid comprises an aseptic liquid introduced into said drum at a temperature of between 30° F. and 45° F.

5. The method of claim 1 wherein said steam pressure within said drum at the time of applying said air tight seal to said drum is in the range of 5 p.s.i. to 15 p.s.i. above ambient pressure.

6. The method of claim 1 further comprising using said steam pressure within said drum to deflect said drum base member axially outwardly of said drum during said application of said air tight seal, whereby the drum base member is, during the sealing step, deflected axially outwardly a distance greater than would result from only the weight of the solid food product and the food packing liquid.

7. The method of claim 6 further comprising supporting said drum base in a manner to permit said axial deflection of the radially central portion of said base member.

* * * * *